United States Patent [19]

Loje

[11] 3,935,997

[45] Feb. 3, 1976

[54] PLEAT COUNTER APPARATUS

[76] Inventor: Michael R. Loje, 959 Rose Blvd., Highland Heights, Ohio 44143

[22] Filed: Oct. 29, 1973

[21] Appl. No.: 410,887

[52] U.S. Cl. ..... 235/98 C; 235/92 V; 235/92 PD

[51] Int. Cl.[2] ..... G06M 7/00; G06G 7/00

[58] Field of Search..... 235/98 C, 92 PD, 92 V

[56] References Cited

UNITED STATES PATENTS

| | | | |
|---|---|---|---|
| 3,234,360 | 2/1966 | Schooley, Jr. | 235/92 PD |
| 3,414,732 | 12/1968 | Stegenga | 235/92 V |
| 3,538,312 | 11/1970 | Genahr | 235/92 V |
| 3,721,819 | 3/1973 | Strandberg, Jr. et al. | 235/92V |
| 3,750,603 | 8/1973 | Martin | 235/92 PD |

*Primary Examiner*—Stephen J. Tomsky

*Attorney, Agent, or Firm*—Teare, Teare, & Sammon

[57] ABSTRACT

A sheet of pleated material is fed from a roll onto a moving belt. A guide means maintains the sheet in alignment. A light source is reflected off the pleats and the reflections from the peaks of the pleats are detected as pulses. These pulses are counted. When a predetermined number have been counted, the last pleat is marked and the counting is continued for another sequence.

17 Claims, 6 Drawing Figures

PLEAT COUNTER APPARATUS

BACKGROUND OF THE INVENTION

1. Field of the Invention

The present invention relates to the counting of corrugations in a material, and more particularly, to the counting of pleats in a flexible material.

2. Description of the Prior Art

A need has existed for an automatic machine for counting the number of pleats in a fabric material. Manual counting not only is time consuming, but is subject to error. The likelihood of such error is increased by the tedius nature of the job.

Problems have existed in the devising of an automatic means for counting pleats. The material is soft and flexible and not easy to handle for automated counting. Where photoelectric counting is considered, a problem exists in that different materials are of different texture and color, thereby varying widely in light reflective characteristics. As a result, some materials have such slight reflection capabilities that the difference in reflective nature between peaks and valleys can not readily be determined. Other materials are so reflective that the reflections from the valleys cannot be distinguished from the reflections from the peaks.

Still another problem is that the spacing between pleats is not uniform. The distance between peaks will vary depending on the heat utilized in their formation. A higher heat will result in more compressed pleats and a lower temperature in wider spacing between the pleats. This variance in spacing from roll to roll of pleated material presents a further problem in automating the counting process.

The need for fast and accurate counting is particularly important where the pleated material is to be used for lampshades.

Commercially, lampshades are manufactured from a continuous roll of pleated material. In assembling the lamp shade it is essential that the lamp shade have a predetermined number of pleats. For example, suppose a lampshade is to be tapered. The manufacturer calculates the number of pleats needed by taking into consideration the size of the shade and height of the pleat. A piece of material hopefully containing the desired number of pleats is cut from the roll. In assembly line practice this desired number was counted manually and marked at each interval where the desired number repeated on the roll. This material, once cut, is then glued and joined at its end to form a sleeve which is then slipped over the lampshade form. If the sleeve does not have the predetermined number of pleats a faulty lampshade will result. If the sleeve has too few pleats it will distort at the bottom thereby stretching the pleats and damaging the saleability of the shade, and thus of the lamp as well. If it has too many pleats, the sleeve becomes loose at the top either before purchase or shortly thereafter thereby resulting in a faulty product.

DESCRIPTION OF THE PREFERRED EMBODIMENTS

Figure 1:
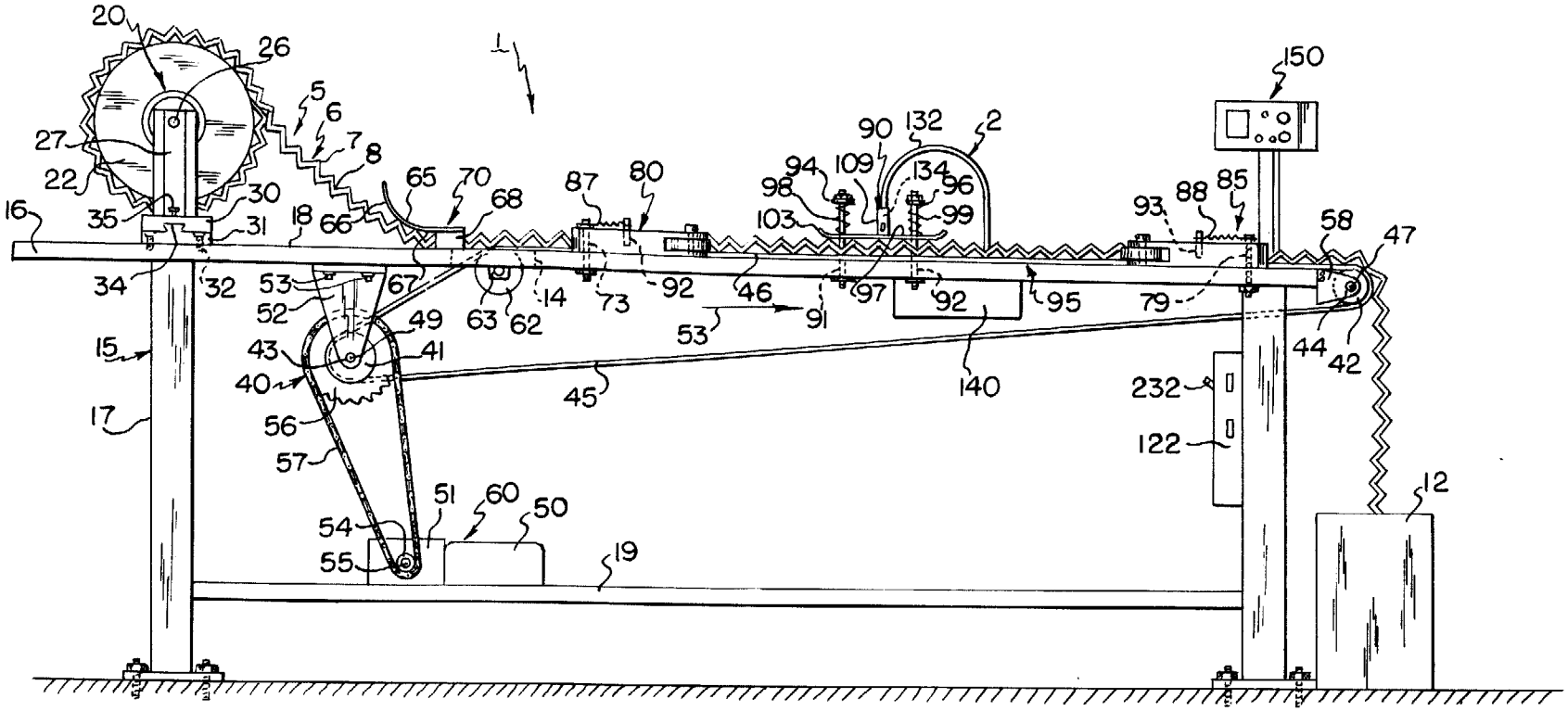
FIG. 1 is an elevation view of the pleat counting apparatus of the present invention.
Figure 3:
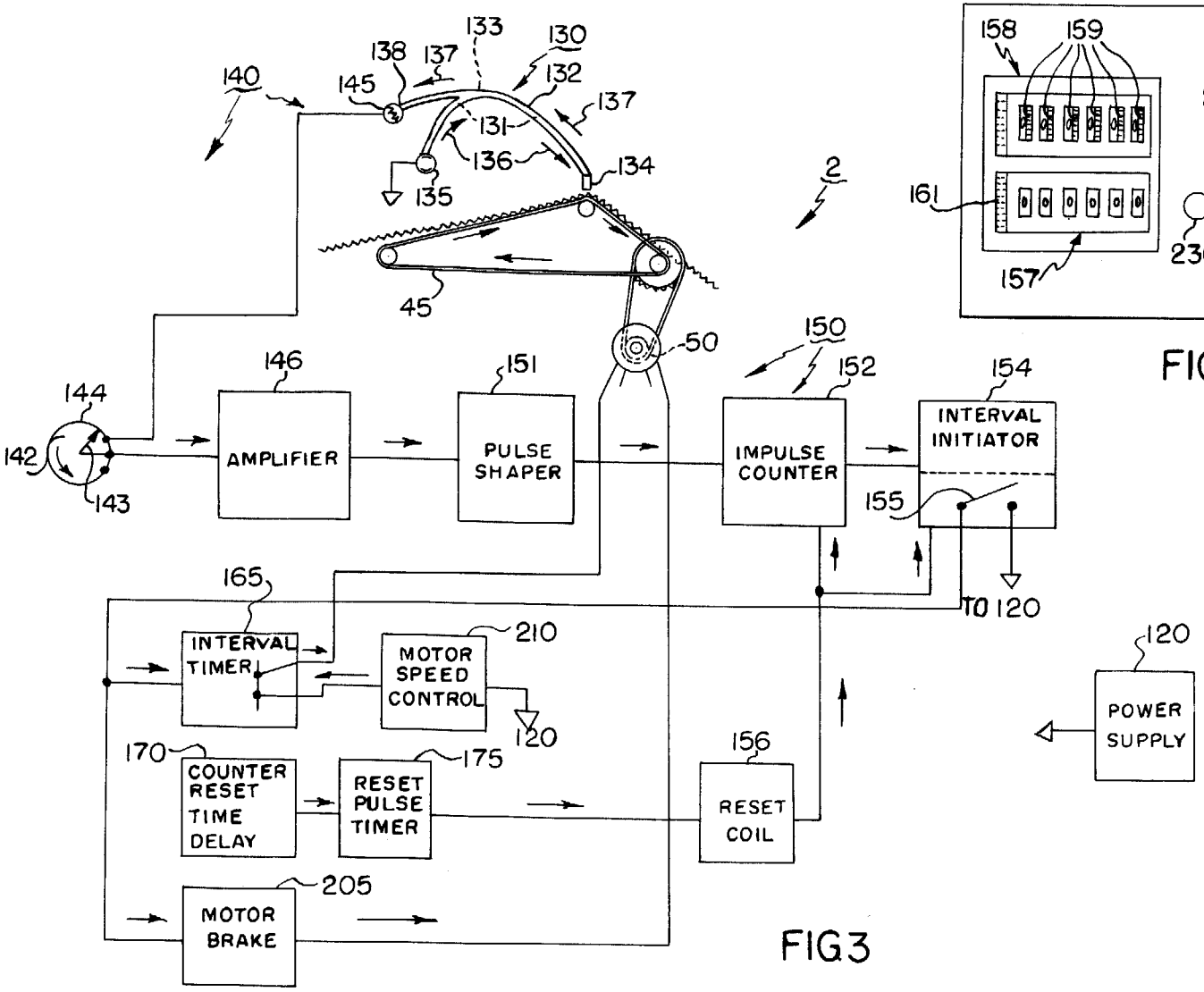
FIG. 3 is a combination schematic and block diagram of the pleat counting system of the present invention.

The pleat counting apparatus of the present invention is illustrated, generally at 1 in FIG. 1, and is shown as including a support table 15 for supporting a sheet 5 of corrugated or pleated material thereon. In the form shown, a material supply mechanism 20 is located at one end of the table 15 and includes a supply spool 22 from which the pleated sheet 5 is fed. A material feed mechanism 40 is supported on the table 15 and includes an endless feed belt 45 which has its upper run, such as at 46 supported for sliding movement on the table 15. A guide assembly 70 directs the pleated sheet 5 from the supply spool 22 into frictional engagement with the feed belt 45 for movement along the table 15. The material feed assembly 40, is shown as including a motor 50 for driving the belt 45 in one direction, such as indicated by the arrow 53, for drawing the sheet 5 from the supply spool 20 and moving the sheet 5, and thus the pleats 6, in succession, past a sensing head assembly 90 of a peak detection, counting and control system assembly 2 which produces light to be reflected off the pleats 6. The light reflections are transmitted by a light transmitting device 132 to a detection system 140 (FIG. 3) which detects only the reflections from the peaks 7 as the pleats 6 pass by the sensing head 90. The counting and control system assembly 2 further includes a presettable counter assembly 150 which is operably connected to the reflection detection system 140 to receive and count pulses representative of the number of pleats peaks as at 7, passing the sensing head assembly 90. When a predetermined number of pulses are counted, an interval initiator 154 causes the belt 45 to stop movement by disconnecting motor 50 from its source of power and applying dynamic brake 205. A counter reset time delay 170 activates the resetting of the counter assembly 150, and a reset pulse timer 175 completes the resetting. An internal timer 165 then recommences the belt movement and the counting of the new group. In the interval where the belt is motionless, the last pleat of a group is manually marked. The counter pleats are moved to a storage location, such as into a container or bin 12 located at the end of the table 15, for future handling as required.

The sheet 5 may be made of any suitable flexible material, and the pleats 6 may be formed in numerous configurations. In FIG. 1, the pleats 6 are shown as being generally sharp or V-shaped folds of generally uniform size and shape, and more particularly, are of the same or similar configuration as corrugations or pleats as one would find in material which is used in the making of pleated lamp shades.

The table 15 may be of any suitable construction including a top 16 which is supported on a framework 17. The table top 16 is shown as including a flat upper surface 18 on which the upper run 46 of the belt 45 is supported and along which the sheet 5 moves during the counting operation.

Figure 2:
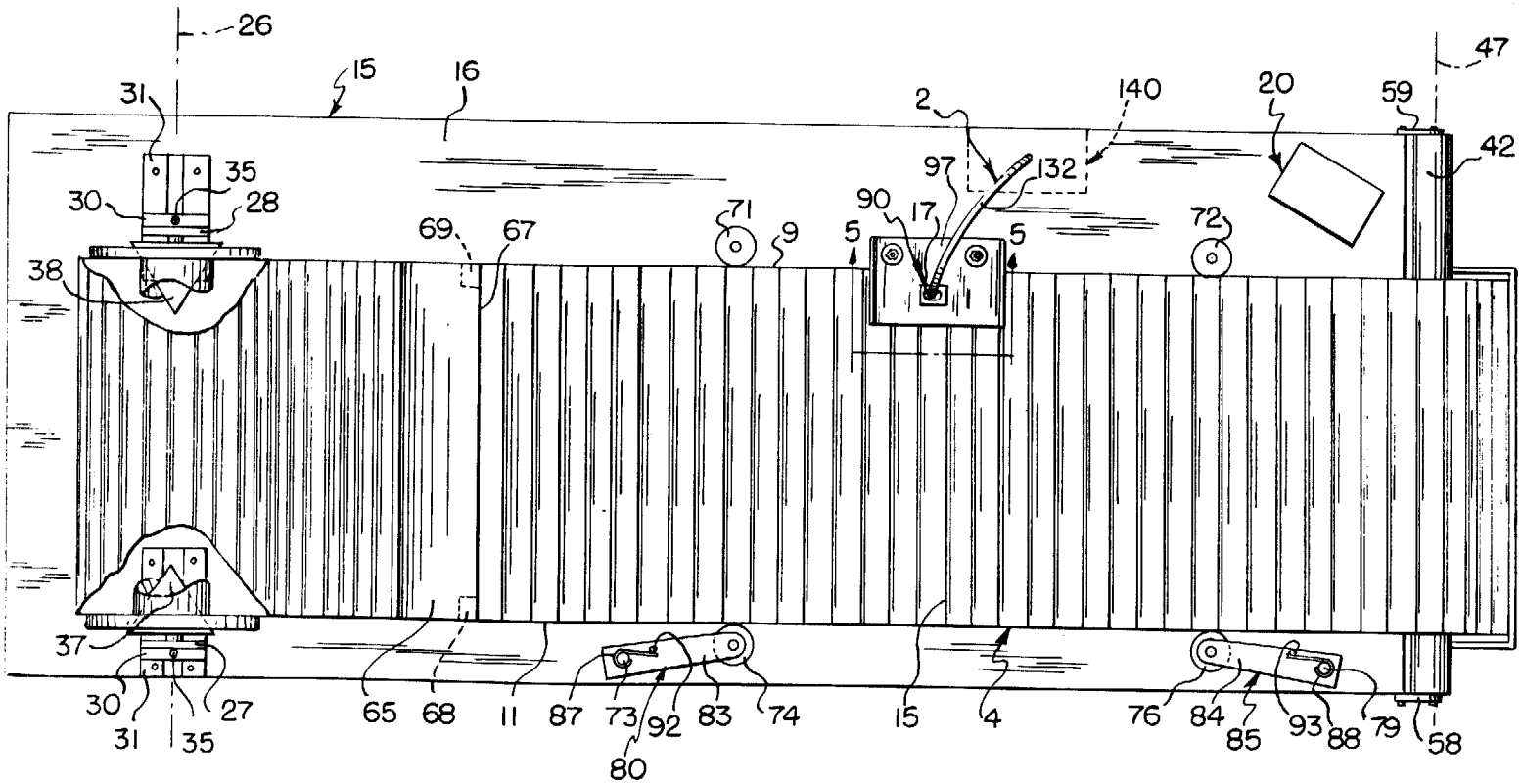
FIG. 2 is a top plan view of the pleat counting apparatus shown in FIG. 1.

As can be seen in FIG. 2, the supply spool 22 is mounted for rotation on a pair of generally upright stanchions 27 and 28 and has its axis of rotation 26 extending transversely to the lengthwise direction of the table top 16 and the direction of feed of the sheet 5. The stanchions 27 and 28 are adjustably mounted on the table 15 for movement toward and away from one another to enable the spool 22 to be removed and replaced after it has been emptied. As shown in FIG. 1, the stanchions 27 and 28 are attached at their lower end to an upper block 30 which is movably mounted on a lower block 31. The lower block 31 is fixedly connected to the table top 16, such as by screws 32 or the like. The upper block 30 may be slidably mounted on the lower block 31, such as by a dove-tail connection as at 34. The screws 32 may be countersunk in the lower block 31 to enable the upper block 30 to slide unobstructed therealong. A set screw 35 may be threadably inserted through the upper block 30 for engagement with the lower block 31 for locking the upper block in fixed relation on the lower block 31, and thus, lock the stanchion 27 in fixed position with respect to the stanchion 28. As shown in FIG. 2, each of the stanchions 27 and 28 may include a cone-shaped support member, such as at 37 and 38, respectively, which is rotatably mounted thereon for engagement with the opposite sides of the reel 7. The support members 37 and 38 are axially aligned with one another for rotation about the rotational axis 26 of the reel 22. By this arrangement, the support member 37 can be shifted outwardly away from the support member 38 to provide sufficient clearance therebetween for the removal of the reel 22 from engagement with the support members 37 and 38.

In the form shown in FIGS. 1 and 2, the material feed assembly 40 includes a pair of pulleys or rollers, such as a drive roller 41 and a driven roller 42, which are mounted in laterally spaced relation along the table top 16 in the direction of travel of the belt 45. The drive roller 41 is shown mounted for rotation on a shaft 49 which is supported at one end of the table top 16 toward the supply spool 22, having its axis of rotation, such as at 43, extending generally parallel to the rotational axis 26 of the supply spool 22. The driven roller 42 is mounted for rotation on a shaft 44 which is supported outwardly from the opposite end of the table 15 having its axis of rotation 47 extending generally parallel to the rotational axes 26 and 43. The shaft 43 has its opposite ends journaled for rotation in oppositely disposed brackets, only one being shown at 52, which depends downwardly from and is disposed in laterally spaced relation across the table top 16, being attached thereby by suitable fasteners 53, such as screws or the like. The shaft 44 may have its opposite ends journaled for rotation in brackets 58 and 59 which project outwardly from the end of the table top 16 in the direction of rotation of the belt 45. The belt 45 is wrapped in driving relation about the rollers 41 and 42 for movement as previously indicated upon actuation of the belt drive unit 60. The belt drive unit 60 is shown mounted on a shelf 19 of the frame 17 below the table top 16. The drive unit 60 includes a drive motor 50 which is preferably of the adjustable speed type for controlling the rate of travel of the belt 45. More particularly, the drive motor 50 may be of the shunt wound D.C. type being arranged for connection to a suitable D.C. power supply as will be described more fully hereinafter. Varying the feed rate of the sheet 5 will be necessary, as the spacing between the respective pleats on different sheets may vary. In addition, the control of the speed rare is important in the sensing operation as well be explained more fully hereinafter. The drive motor

50 drives, through a speed reducer 51, a drive sprocket 54 which is mounted on a drive shaft 55 of the speed reducer 51. The various components are selected to give the belt 45 a speed range of between 10 and 25 feet per minute. A driven sprocket 56 is rigidly connected to the shaft 43 for rotation about the axis 49. An endless drive element 57, such as a chain or the like, is engaged in driving relation about the sprockets 55 and 56 for imparting rotation to the roller 41. By this arrangement, actuation of the motor 50 will cause the belt 45 to be moved, such as in the direction indicated by the arrow 53, along the table top 16.

The table top 16 may be made of any suitable substantially rigid material, such as metal or the like, and includes an opening or slot 14 disposed between its opposite ends. As shown, the slot 14 is disposed between the rollers 41 and 42, being adapted to receive the belt 45 therethrough and enable the belt 45 to pass from the underside to the top side of the table top 16. A guide roller 62 is mounted on the table top 16 within the slot 14, being journaled for rotation adjacent its opposite ends in brackets 63 attached to the underside of the table top 16. The roller 62 has its axis of rotation extending generally parallel to the rotational axis 49 of the roller 41, and has its outer periphery disposed generally tangentially to the general plane of the upper surface 18 of the table top 16. By this arrangement, the belt 45 will be driven by the roller 41 upward through the slot 14 and around the roller 62. As the roller 41 has its periphery disposed generally tangentially to the general plane of the upper surface 18, the belt 45 will move off the roller 62 and onto the upper surface 18 for sliding movement along the table top 16. The belt 45 will then move off of the end of the table 16 around the roller 42, and then back to the roller 41.

The guide assembly 70 includes a curved sheet or plate 65 which extends transversely of the table top 16. As shown in FIG. 1, the plate 65 is supported adjacent its opposite ends by brackets 68 and 69 in spaced relation above the upper surface 18 having one end, such as its lower end 67 spaced above the upper surface 18 a distance approximately equal to the height of the pleat peaks 7 to enable the sheet 5 to pass thereunder. The plate 65 extends in one direction toward the feed roll 22, gradually curving upwardly away from the upper surface 18 presenting a curved guide surface 66 for engagement with the sheet 5 as it is drawn off of the feed roll 22 for directing the sheet 5 into engagement with the belt 45. The plate 65 may be any suitable material, such as metal, plastic or the like, which can be provided with a generally smooth surface to facilitate sliding movement of the sheet 5 therealong.

The guide assembly further includes a pair of stationary rollers 71 and 72 (FIG. 2) which are rotatably mounted adjacent one side of the table 15 for engaging one edge, such as at 9, of the sheet 5 to position the sheet 5 for movement past the sensing head assembly 90, and a pair of movable roller assemblies 80 and 85, having respective rollers 74 and 76, mounted on the opposite side of the table top 16 for engaging the opposite edge, such as at 11, of the sheet for biasing the sheet 5 into engagement with the stationary rollers 71 and 72. The movable rollers 74 and 76 are rotatably mounted on levers 83 and 84 which are pivotally mounted on posts 73 and 79, respectively, which are supported on and extend upwardly from the table top 16. Each of the levers 83 and 84 includes an upwardly projecting pin 92 and 93 respectively, for engaging one end of springs 87 and 88. The springs 87 and 88 may be disposed in encircling relation about the posts 73 and 79 having one end fixedly connected to the posts 73 and 79 for causing the springs to be compressed when the levers move in a direction away from the sheet 5, and thus, cause the rollers 74 and 76 to urge the sheet 5 in a direction toward the rollers 71 and 72. As the sheet 5 is generally made of light weight material, the force applied by the springs 87 and 88 need only be very small so as not to overcome the frictional force applied between the belt 45 and the sheet 5 and impede the movement of the sheet 5 along the table top 16.

Figure 4:
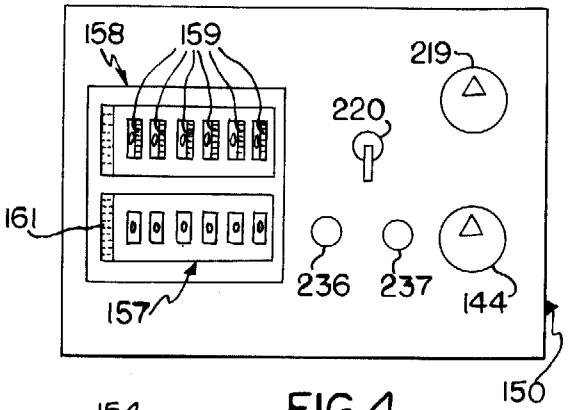
FIG. 4 is a front elevational view of a typical counting device for use in the present invention.
Figure 6:
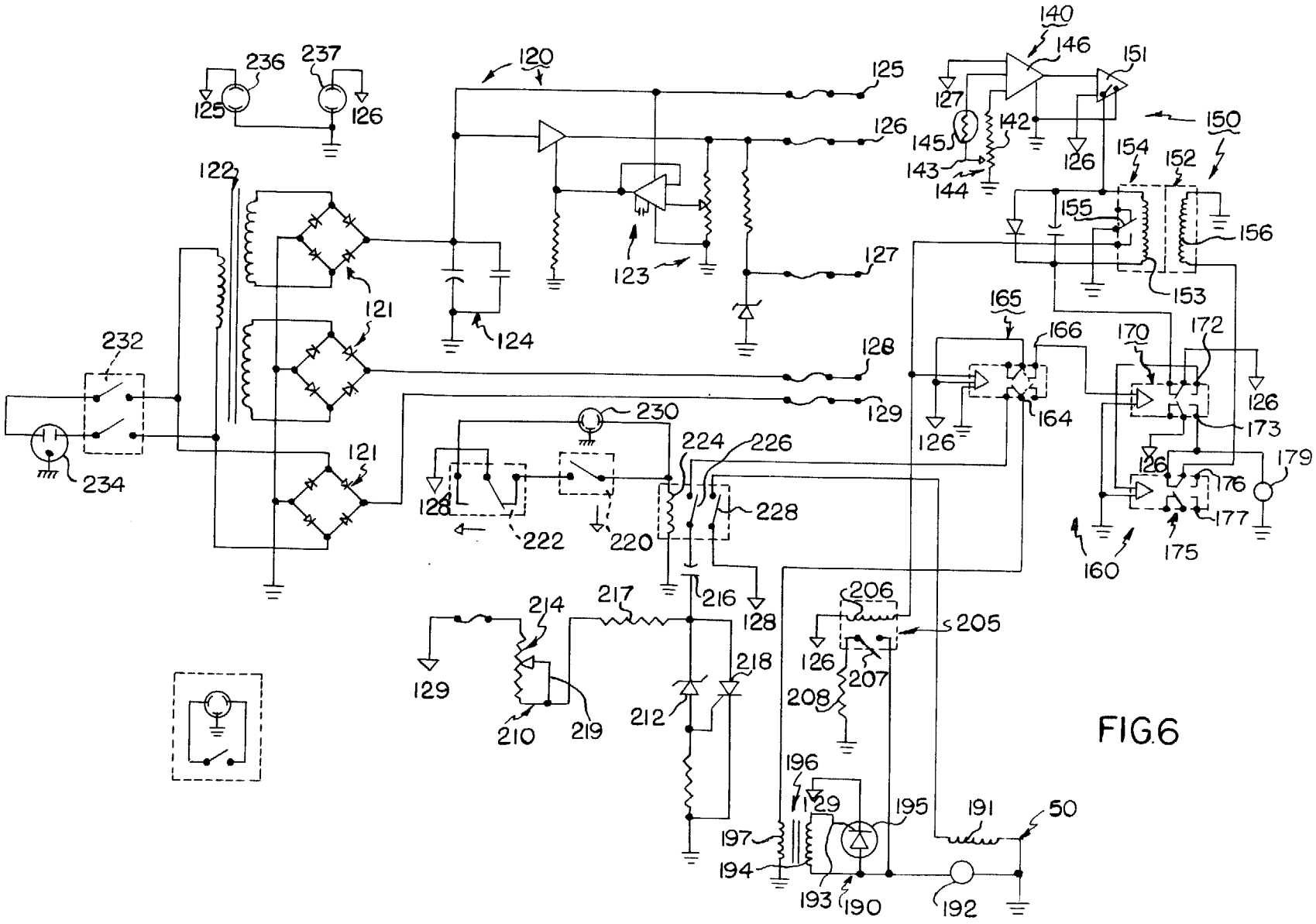
FIG. 6 is a schematic diagram of the pleat counting system of the present invention.

Referring now to FIGS. 4 and 6, the counting of the pleats and the coordinated control of the feeding mechanism is accomplished by the peak detection counting and control system 2. The system 2 is supplied with electrical power from a D.C. power supply system 120. Reference numerals in FIG. 6 adjacent arrow-head-shaped terminals bear the number of the power supply tap from which the power for the various components is drawn. As shown in FIG. 6, such power is supplied from output taps 125, 126, 127, 128 and 129, which supply D.C. voltages of 30 volts, 24 volts, 9 volts, 40 volts and 115 volts respectively. Such D.C. output voltage is converted from A.C. line voltage by conventional full wave rectifiers 121. The output voltage for taps 125–128 is stepped down from line voltage by the transformers shown generally at 122; the voltage for taps 126 and 127 is regulated by a conventional voltage regulator 123; and the voltage for taps 125–128 is filtered as at 124.

Figure 5:
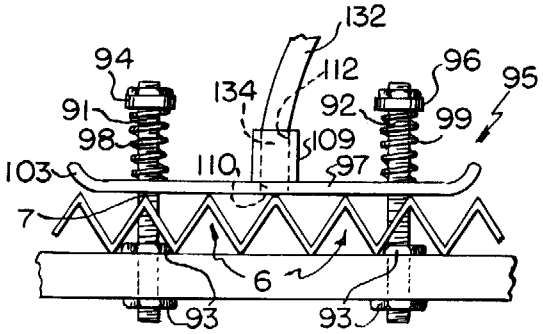
FIG. 5 is an elevational view taken along the line 5—5 of FIG. 2.

Referring now to FIGS. 1, 2 and 5, the sensing head assembly 90 of the peak detection counting and control system 2 includes holder assembly 95, which supports the projecting-receiving end 134 of a light transmitting device 132. As shown, the holder assembly 95 includes a holder plate 97 which is of a generally flat construction being arranged to ride on the peaks 7 of the pleats 6. The holder plate 97 may be made of any suitable material, such as stainless steel or the like, which has generally rigid characteristics and can be provided with a generally smooth finish to facilitate sliding contact with the peaks 7. The holder plate 97 is mounted on posts 91 and 92 for sliding movement upwardly and downwardly relative to the table top 16. The posts 91 and 92 may be secured to the table top 16 in any suitable manner, and in the form shown are held in position by nuts, such as at 93, which are threadably connected adjacent the lower end of the posts 91 and 92. Resilient members, such as helical springs 98 and 99, are disposed in encircling relation about the posts 91 and 92 having their lower ends disposed in abutting engagement with the table top 18 and nuts 94 and 96 threadably secured adjacent the upper ends of the posts 91 and 92 for biasing the holder plate downwardly in a direction toward the table top 18. By this arrangement, the holder plate 97 is forced downwardly and held against the sheet 5 by the force of the springs 98 and 99 for reasons which will become more apparent hereinafter. The lead end of the holder plate 97 is turned up, as at 103, so as to enable the sheet 5 to move freely and unobstructedly into engagement with and under the holder plate 97.

As shown in FIG. 5, the plate 97 includes an aperture 110 therein. A cylindrical sleeve 109 is affixedly connected, such as by welding or the like, to the holder plate 97 and projects upwardly therefrom. As shown best in FIG. 5, the opening or aperture 110 is disposed generally centrally in the holder plate 97, and the sleeve 109 is provided with a lengthwise extending bore 112 which is disposed in axial aligned relation with the aperture 110 so as to be in open communication thereto. The projecting-receiving end 134 of the light transmitting device 132 is held in bore 112 so as to project and receive light through the aperture 110.

A reflection generating and receiving system 130 which may be supported on the table in any suitable manner projects light through the transmitting device 132 into the pleats 6 and transmits the reflections therefrom to a detecting system 140. As shown schematically in FIG. 3, the reflection generating and receiving system 130 includes a light source 135 and the light transmitting device 132. The light transmitting device 132 may be of the fiber optic type such as model ET–636 as manufactured by Dolan-Jenner Industries of Melrose, Mass. which includes a first set of fibers 131 for transmitting light and a second set of fibers 133 for receiving reflected light. In such a device, the transmitting and receiving fibers 131 and 133 are randomly bundled with each being clad to prevent interference with adjacent fibers. For best results, the end of the fibers adjacent the projecting-receiving end 134 should extend generally perpendicular to the general plane of the sheet 5 passing under the sensing head assembly 90. As previously stated, the projecting-receiving end 134 of the light transmitting device 132 is mounted in the bore 112 of the sleeve 109 so that one end of each fiber is exposed in open communciation with the aperture 110 in the holder plate 97. In such arrangement, the first set of fibers 131 transmits light in the direction of the arrows 136 from the light source 135 to the projecting-receiving end 134 of the device 132. The second set of fibers 133 receive the light reflected from the pleats 6 and transmits it in the direction of the arrows 137 to the detecting end 138 of the device 132.

The peak reflection detection system 140 (FIG. 3) of the system includes a photocell 145, a sensitivity adjuster 144, and an amplifier 146. The peak reflection detection system 140 detects the peak 7 of the material 5 as pulses of light are received from the light transmitting device 132. Since the sensing head assembly 90 is disposed above the pleated material, the degree of intensity of the reflected light transmitted to the detecting end 138 of the device 132 will depend on the difference in reflective quality between the peaks 7 (FIG. 1) and the valleys 8 of the pleats 6. Since the peaks of the pleats are closest to the projected light and are free of shadows, whereas the valleys are further away, and may be in shadow, the light reflected from the peaks 7, as the material moves past the aperture 110 of the sensing head assembly 90, will be greater than the light reflected from the valleys 8. As a result, the light reflections transmitted in the direction of arrows 137 (FIG. 3) of the light transmitting device 132 will be of alternating greater and lesser intensity. The reflections of lesser intensity which emanate from the valleys 8 are sufficiently disbursed or of such low magnitude that they are not sensed by the sensitivity regulated photocell 145 which is "tuned" to detect only the brighter reflections, as explained hereinafter. As a result of such light and dark alternation, a "pulse" of light is detected by the photocell 145 each time a peak passes under the sensing head assembly 90.

In achieving the desired reflections, the distance between the projecting-receiving end 134 of the light transmitting device 132 and the peaks 7 of the pleats 6 is critical. For example, where the aforesaid device is used in conjunction with a 9-volt focused bulb, as the light source, which draws 400 milliamperes and is powered by 9 volts regulated d.c. from the tap 127, the light transmitting device 132 should be positioned in the sleeve 109 so that the distance between the projecting-receiving end 134 of the light transmitting device 132 and the peaks 7 of the pleats 6 should be between 1/16 and ⅛ of an inch. A direct current source is used to prevent the reflection variations from being influenced by variations in the light source intensity.

In order to regulate the sensitivity of the photocell 145 to prevent the detection of any reflections from the valleys 8 of the pleats 6, sensitivity adjuster 144 is provided to reduce the light sensitivity of the photocell 145 to make it insensitive to reflections of the lesser magnitude of reflections from the valleys. This is especially important where the pleated material is of a highly reflective character. Such an adjustment is provided by a 1000 ohm linear type of adjustable potentiometer, shown generally at 142 (FIG. 6), having a movable potentiometer arm 143 connected in series with the photocell 145, and manually adjustable to vary the voltage across the photocell 145 until clear and distinct pulses are obtained from a test run of the material to be counted, as explained later. By such adjustment, only the reflections from the peaks 7 of the pleats 6 are sensed by the photocell 145, with the reflections from the valleys 8 being undetected, thereby resulting in a true count output from the photocell.

For these cases where the material to be counted is of low light reflective capability, a high gain amplifier 126 is provided. When the amplifier 126 is connected across the photocell 145, it will magnify the reflections from the pleat peaks 7 sufficiently to provide the necessary pulses for accurate counting. By varying the gain of the amplifier 126 and the position of the potentiometer arm 143, the pleats 6 can be counted in material which has high, low or average reflectability characteristics.

The pulse counter assembly 150 of the system 2 includes a pulse shaper 151 to sharpen the pulses, an impulse counter 152 to count the pulses, a preset interval initiator 154 to control the number of pulses counted in a group and to activate and deactivate the material feed mechanism 40, and a reset coil 56 to reset the counter 152 prior to the start of the counting for the next successive group.

The pulse shaper 151, in the form of a transistor static switch, converts the rounded off pulse outputs from the amplifier into square waves. By such means, sharp distinguishable pulses are provided as triggers for the counting stage.

The impulse counter 152 may be of the static type as manufactured by Hengstler of Germany and distributed in the United States by the Hecon Corporation of New Shrewsburg, N.J., and is shown only in block diagram in FIG. 6. In such a device, a voltage output is produced which is proportional to a continuous summation of the number of pulses counted. The counter also has two visual digital readouts, one of which progressively increases to provide a visual indication of the number of pulses counted, as at 157, and the other, such as at 158, of which is presettable at a selected number indicative of the number of pulses to be counted in a group, and which progressively decreases to indicate the number of pulses remaining to be counted in the group. Of the two visual readouts, one readout is a numerical readout of the number of pulses, and thus, the number of pleats counted for the group. The second readout is a subtracting one which commences at a preset number. The preset number is the total number expected to be counted (e.g. the total number of pleats to be on each lamp shade). This readout progressively reduces by one unit at a time until it reaches zero. At the completion of each group an operator can look at the total number counted, and if it exceeds the preset number, he can then manually count back the number of pleats and place an indicator, such as a paper clip, thereon to indicate, as well as, account for the error. The interval initiator switch 154 is shown schematically as a solenoid coil 153 and a normally-open, single-pole, double-throw switch 155.

The closing of the interval initiator switch 155 applies the dynamic brake 205 for stopping the belt drive motor 50 in a manner to be described in more detail later. The closing of switch 155 also energizes the static switch interval timer 165 which includes a built-in timing mechanism (not shown) that causes the immediate closing of a static switch 164 to cut off the power to motor 50 which also will be described in more detail later. The timing mechanism also immediately closes a switch 166 to activate counter reset time delay relays 170 and 175. The timer portion of the interval timer 165 holds the switch 164 open and the switch 166 closed for a predetermined time period, such as 5 seconds, which is necessary for resetting the inpulse counter 150. The interval timer 165 is such that its activation depends merely on a momentary pulse.

The counter reset time delay 170 is a timing device which will close its contacts at the end of a delay, such as 2½ seconds after the activation of the interval timer 165. Such delay prevents the resetting of the counter until after the drive motor 50 and belt have stopped. It is understood that each item to be counted will be spaced sufficiently apart from each other that the next item will not come under the aperture 110 of of the sensing assembly 90 within such 2½ second period. Similarly, the speed of the belt and the braking ability must be adjusted so that the belt will come to a stop within such period. The counter reset time delay relay 170 is a normally-open, adjustable type to enable varying of the delay period. Upon completion of such preset delay time, the switch contacts close to complete the circuit. An example of such a switch is Model No. 2211 as manufactured by General Time Co., of Thomaston, Conn.

The delay relay is connected in the circuit with a second counter reset time delay relay, which for purposes of description will be referred to hereinafter as a reset pulse timer 175. The reset pulse timer 175 determines the length of time that current will flow through the reset coil for the impulse counter 150. The reset pulse time 175 is normally biased closed and is set to open a predetermined time after it is actuated. Such switch may be set to open in ½ second after it is actuated. An example of such a switch is Model No. 2211 as manufactured by General Time Co., of Thomaston, Conn. The reset coil shown schematically at 156 is a conventional coil for resetting a static counting mechanism to zero. Such coil is made as an integral part of the impulse counter 152 manufactured by Hengstler and referred to previously. Upon being connected to the source of power for the period of time determined by the reset pulse timer 175, the reset coil 156 causes a resetting of the impulse counter 152 as is known in the art. When the counter 152 resets, the voltage level across the coil 153 drops below the preset value and switch contacts 155 open to cut-out dynamic brake 205 from the motor winding circuit.

Upon completion of the preprogrammed five second built-in time delay of the interval timer 165, the timer closes the switch 64 and opens the switch 166, thereby starting the motor 50 and deactivating the counter reset delay relay 170.

The speed of movement of the belt 45 must be regulated. It cannot be too slow or efficiency of operation is lost; it cannot be too fast or it will be moving faster than the photocell can react to the difference in light reflection. Similarly, the speed of the belt 45 must be regulated for the braking timing. To achieve such regulation of the speed of the belt 45, the drive motor 50 is preferably of the d.c. shunt-wound type having a field winding 191 and an armature winding 192, with the brake voltage across the armature and the speed of the motor being controlled by a speed regulator 210.

As shown in FIG. 6, the armature 192 is connected to the 115 volt unfiltered full wave rectified d.c. source at the tap 129 through SCR 195. Thus, the average voltage across armature 192, and thus the speed of the motor 50, is dependent on the timing of the firing of the SCR 195 in each cycle which, in turn, is determined by the timing of voltage impressed across the primary winding 197 of a transformer 196 which is coupled to the secondary winding 194 in the gate circuit of the SCR 195. The timing of the application of gating voltage to primary winding 197 to turn on SCR 195 during each cycle is determined by an RC timing circuit of a variable resistor 214, a fixed resistor 217 and a capacitor 216. The variation of resistor 214 varies the rate of charging of the capacitor 216 and thus the timing of firing of the SCR 195. The resistor 214 may be varied by a speed control knob 219 in the face of the impulse counter 152 (FIG. 4) A zener effectively cuts off any gating pulse to the SCR 195 and thus, shuts off the motor 50 whenever the switching 164 is opened as previously described.

A dynamic brake 205 is provided in the form of a braking resistor 208 which is connected across the armature 192 by the closing of contacts 207 when the coil 206 is energized. Dynamic brake 205 slows the motor 50 rapidly to a stop when the motor 50 is cut off from its power source by the opening of the gating circuit of the SCR 195, as aforesaid. The energization of the coil 206, and the application of the braking resistor 208 is caused by the closing of the switch contacts 155 of the interval initiator 154, as previously described.

The control system can be turned on manually as by the switch 220 or by some form of automatic device, such as at 222, which is well-known in the art. In either event, contacts 226 and 228 are closed to energize the motor armature winding 192 and field winding 191. A pilot light 230 may be provided which indicates when the motor is "On." Similarly, the manual switch 232 connects the power supply 122 for all of the components to a suitable a.c. power source, such as 120 volts single phase, by a plug 134. Pilot lights 236 and 237 indicate that circuits connected to power taps 125 and 126 are operating. The pilot light 179 indicates that the counter is being reset.

OPERATION

The first step in the operation, after turning on the power, is to set the adjustable components. This is done in conjunction with a preliminary run. The speed of the conveyor is preliminarily adjusted by placing potentiometer 214 at its mid-position so as to have the belt 45 moving at its mid-speed range of 18 feet per second. The next preliminary step is to adjust the potentiometer 144 while observing the movement or appearance of the digits of the visual readouts on the counter 150. If the visual readout stays in a half-digit position or indicates only the first digit, the sensitivity is too high and a continuous reflection is being detected. In this event, the sensitivity must be lowered by adjusting the potentiometer 144 to decrease the amount of voltage across the photocell 145 until the visual readout begins to indicate numbers greater than zero. The next step is to determine the optimum operating speed for the belt 45. This is accomplished by progressively increasing the speed of the belt 45 until irregularities are noted in the appearance of the visual readout digits of the counter 150. Such irregularity, for example, would be where the digits do not appear in a constant or smooth frequency. The belt speed must then be slowed to a speed where the readout digits again begin to appear at a constant frequency. Before beginning the actual counting, the predetermined number of pleats to be counted should be preset by turning the preset knobs, as at 152, of the visual readouts 158 of the counter 150 until the predetermined total number is reached. Similarly, the other visual readout 157 of the counter should be reset to zero by turning the reset knob 161 back to this figure. The machine is now set to automatically count the desired number of pleats.

In operation, the pleated material 5 is pulled from the supply spool 22 and under guide 70, and along the table 16 by the movement of the belt 45. As the web 5 of the pleated material passes under the sensing head 90, light is reflected off the pleats 6 and transmitted to the peak detection system 140 by the reflection generation and transmitting system 130. The peak detection system 140 detects those reflections which come from the peaks 7 of the pleats 6 and emits a pulse for each pleat passing the sensing head 90. The impulse counter 152 counts these pulses until the number counted reaches the predetermined level to close the interval initiator switch contacts 155 to apply the dynamic brake 205 and to activate the interval timer 165. The activation of the interval timer 165 (1) commences the timing of the interval between the completion of the counting of one group of pleats and the start of the counting of the next one; (2) opens contacts 164 to disconnect the motor 50; and (3) closes contacts 166 to activate the counter reset delay relay 170 to commence the timing of the delay between the initiation of the stopping of the belt 45 and the start of the counter reset. In the interval between groups, the pleat just beyond the holder is marked in some fashion, such as by manually placing a paper clip thereon. Such mark indicates the completion of the counting of one group. Such mark could also be placed automatically by a device (not shown or described) and which is activated by the interval initiator. At the completion of the time delay, the contacts 164 close, thereby activating the reset pulse timer which supplies current to the reset coil of the counter for the necessary period of time to reset the number counter to zero and to reset the group total counter to the number of pleats to be counted. At the end of the interval between counting of the groups, the interval timer causes an opening of contacts and a closing of contacts to start the motor and to commence the counting for a new group.

I claim:

1. An apparatus for counting corrugations of any configuration in a sheet material, comprising support means for supporting said sheet material thereon, a corrugation detection assembly mounted on said support means in confronting relation to the peak of each corrugation and including, light producing means including a light source on said support means for delivering light toward said sheet material for reflection therefrom, light sensing means including a light sensitive element for sensing light of a predetermined level of intensity reflected from each corrugation and for producing a first output signal when light of said predetermined level of intensity is reflected from said material, and commonly supported and directed light projecting and receiving means for projecting light from said light source and for receiving reflected light from said sheet material, said light projecting and receiving means including transmitting means for directing light in one direction toward said sheet material and for receiving reflected light from said sheet material in a direction substantially opposite from and generally parallel to said one direction and generally perpendicular to said sheet material so that said reflected light from the corrugation being counted will not be obstructed by an adjacent corrugation to assure exposure of said receiving means to reflected light of said predetermined level of intensity from the corrugations being counted and to enable counting of corrugations of any generally similar configuration, feed means mounted on said support means for moving said sheet material relative to said support means, and pulse counting means for counting said first output signal to indicate the number of corrugations of any generally similar configuration moving relative to said corrugation detection assembly.

2. An apparatus in accordance with claim 1, wherein said light sensing means includes an adjustable sensitivity means for controlling the magnitude of said first output signal to establish said predetermined level of intensity.

3. An apparatus in accordance with claim 1, wherein said feed means includes an adjustable-speed drive means, and feed speed control means is operably connected to said drive means for adjusting the speed thereof and controlling the rate of movement of said sheet material relative to said light producing means to achieve an optimum operating speed.

4. An apparatus in accordance with claim 3, wherein said feed speed control means includes interval timing means for initiating and terminating movement of said sheet material, said pulse counting means comprises an impulse counter for producing a second output signal after counting a predetermined number of pulses, and said interval timing means is operably connected between said impulse counter and said drive means for receiving said second output signal to terminate movement of said sheet material.

5. An apparatus in accordance with claim 4, wherein said impulse counter includes reset means for resetting the count thereon, and said interval timing means includes a first time delay assembly having a first time delay period to provide time for resetting said impulse counter while said sheet material is not moving.

6. An apparatus in accordance with claim 5, wherein said interval timing means includes another time delay assembly having another time delay, which is less than said first time delay period and commences after and terminates prior to said first time delay period to assure that said sheet material will not move while resetting said impulse counter.

7. An apparatus in accordance with claim 1, wherein said support means comprises a bench, said feed means includes an endless belt supported for movement along said bench, and drive means operably connected to said belt for moving said belt relative to said bench.

8. An apparatus in accordance with claim 7, including a roller assembly having a pair of roller members mounted for rotation on said bench, said flat belt includes an upper run and a lower run, said bench includes a top, and said roller members are supported in laterally spaced relation adjacent said top for rollingly supporting said upper run for movement along the top of said bench.

9. An apparatus in accordance with claim 8, wherein said drive means is mounted on said bench below said top, said top has an opening therein, one of said roller members is mounted within said opening, and said upper run extends from said one roller member and downward through said opening for connection to said drive means.

10. An apparatus in accordance with claim 7, wherein said drive means comprises an adjustable-speed motor.

11. An apparatus in accordance with claim 8, including material supply means mounted on said bench having a supply of sheet material thereon, said material supply means including guide means for directing said sheet material toward said belt for movement along said top of said bench, and said guide means includes a guide surface slidably engaging said sheet material and to urge said sheet material onto said belt.

12. An apparatus in accordance with claim 8, including a corrugation detection assembly mounted on said bench, said corrugation detection assembly includes a detection head supported between said rollers in overlying relation with respect to said top, and said detection head is movable relative to said top forming a space for receiving said sheet material therethrough.

13. An apparatus for counting corrugations of any configuration in a sheet material, comprising support means for supporting said sheet material thereon, a corrugation detection assembly mounted on said support means in confronting relation to the peak of each corrugation and including, light producing means including a light source on said support means for delivering light toward said sheet material for reflection therefrom, light sensing means including a light sensitive element for sensing light of a predetermined level of intensity reflected from each corrugation and for producing a first output signal when light of said predetermined level of intensity is reflected from said sheet material, and light projecting and receiving means for projecting light from said light source toward said sheet material and for receiving reflected light from said sheet material, said light projecting and receiving means including transmitting means for directing light from said light source toward said sheet material and for directing reflected light from said sheet material to said light sensitive element, said transmitting means comprising fiber optic strands including, one set of strands having one end operably connected to said light source and the opposite end supported for projecting light onto said material, and another set of strands having one end operably connected to said light sensitive element and the opposite end supported for receiving reflected light from said sheet material, said opposite ends of said sets of strands being disposed in close proximity to one another for projecting and receiving light in a generally common path, feed means mounted on said support means for moving said sheet material relative to said support means, and pulse counting means for counting said first output signal to indicate the number of corrugations of any generally similar configuration moving relative to said corrugation detection assembly.

14. An apparatus in accordance with claim 13, wherein said corrugation detection assembly includes a detection head having an aperture therein, and said projecting and receiving means includes a common projecting and receiving end connected to said detection head in axial alignment with said aperture for positioning said projecting and receiving end in closer proximity to the peak of the corrugation being counted than the remainder of the sheet material for projecting and receiving light through said aperture to avoid obstruction of reflected light.

15. An apparatus in accordance with claim 14, wherein said detection head includes a contact surface, said projecting and receiving end being positioned a predetermined distance from said contact surface, and said contact surface is supported for contact with said sheet material in confronting relation to the peaks of said corrugations for positioning said projecting and receiving end within a predetermined distance in close proximity to said peaks for sensing light of said predetermined level of intensity when counting corrugations of varying height.

16. An apparatus in accordance with claim 14, wherein said detection head comprises a plate, said projecting and receiving end is exposed to said space through said aperture for directing light onto and receiving reflected light from said sheet material through said aperture, and said corrugation detection assembly includes a resilient means for biasing said plate into sliding engagement with said sheet material as it moves relative to said support means.

17. An apparatus for counting corrugations of any configuration in a sheet material, comprising support means for supporting said sheet material thereon, a corrugation detection assembly mounted on said support means in confronting relation to the peak of each corrugation and including, light producing means on said support for delivering light toward said sheet material for reflection therefrom, light sensing means for sensing light of a predetermined level of intensity reflected from each corrugation and for producing a first output signal when light of said predetermined level of intensity is reflected from said material, and light projecting and receiving means for projecting light from said light producing means in one direction toward said sheet material and for receiving reflected light from said sheet material in a direction substantially opposite to said one direction to assure exposure of said receiving means to reflected light of said predetermined level of intensity, feed means mounted on said support means for moving said sheet material relative to said support means, pulse counting means for counting said first output signal to indicate the number of corrugations of any configuration moving relative to said corrugation detection assembly, said light producing means comprises a light source, said light sensing means comprises a photocell, said light projecting and receiving means comprises a bundle of fiber optic strands for transmitting light from said light source to said sheet material and for transmitting reflected light from said sheet material to said photocell, and said bundle having a common projecting and receiving end for sensing light reflected in a direction substantially opposite to the direction in which it is projected.

* * * * *